United States Patent [19]

Numazawa et al.

[11] Patent Number: 4,599,051

[45] Date of Patent: Jul. 8, 1986

[54] VANE TYPE ROTARY PUMP

[75] Inventors: Akio Numazawa, Toyota; Keiichi Nakamura; Toshifumi Sakai, both of Kariya, all of Japan

[73] Assignee: Toyota Jidosha Kabushiki Kaisha, Aichi, Japan

[21] Appl. No.: 769,968

[22] Filed: Aug. 27, 1985

[30] Foreign Application Priority Data

Aug. 28, 1984 [JP] Japan ..... 59-180138

[51] Int. Cl.[4] ..... F04B 49/08; F04B 49/10

[52] U.S. Cl. ..... 417/293; 417/299; 417/302; 417/310

[58] Field of Search ..... 417/310, 802, 303, 299, 417/293

[56] References Cited

U.S. PATENT DOCUMENTS

| | | | |
|---|---|---|---|
| 2,649,737 | 8/1953 | Hoen et al. | 417/310 |
| 2,933,158 | 4/1960 | Pitts | 417/310 X |
| 4,452,571 | 6/1984 | Koda et al. | 417/293 X |

*Primary Examiner*—Richard E. Gluck
*Attorney, Agent, or Firm*—Parkhurst & Oliff

[57] ABSTRACT

A vane type rotary pump comprises a cam ring mounted within a stator housing and having an inner peripheral wall defining four circumferentially equispaced semicylindrical inner cam surfaces, a pair of end wall structures fitted to opposite ends of the cam ring to form a pump cavity, a drive shaft rotatably mounted within the stator housing, a rotor contained within the pump cavity and mounted on the drive shaft for rotation therewith, and a plurality of circumferentially equispaced vanes slidably fitted in the body of the rotor to cooperate with the inner cam surfaces to form four pairs of suction and delivery chambers. One of the end wall structures is formed with four pairs of circumferentially spaced suction and delivery ports in communication with the respective suction and delivery chambers, and a pair of changeover valves are disposed within a pair of delivery passages in connection to a pair of the diametrically opposed delivery ports to connect the delivery passages to the suction ports associated with the diametrically opposed delivery ports in their activated conditions and to disconnect the delivery passages from the suction ports in their deactivated conditions. The changeover valves are arranged to be simultaneously activated when the rotational speed of the drive shaft exceeds a predetermined value.

2 Claims, 4 Drawing Figures

VANE TYPE ROTARY PUMP

BACKGROUND OF THE INVENTION

The present invention relates to a vane type rotary pump, and more particularly to a vane type rotary pump, for example, suitable for use in a vehicle power steering system.

In a conventional vane type rotary pump of this kind, there is provided a flow control valve in which a spool is displaced by the difference in pressure acting on its opposite ends to permit the flow of an excessive amount of discharged fluid into a bypass passage when the rotational speed of the pump has exceeded a predetermined value thereby to constantly supply a predetermined quantity of pressurized fluid into a hydraulic circuit for the power steering system. In such a control of the discharged fluid, the excessive amount of fluid flowing into the bypass passage increases in accordance with increase of the rotational speed of the pump. This results in increase of the load torque in operation of the pump.

SUMMARY OF THE INVENTION

It is, therefore, a primary object of the present invention to provide an improved vane type rotary pump wherein the excessive amount of fluid flowing into the bypass passage is decreased in accordance with increase of the rotational speed of the pump so as to reduce the load torque in operation of the pump.

Another object of the present invention is to provide an improved vane type rotary pump, having the above-described characteristic, wherein four pairs of circumferentially equi-spaced suction and delivery chambers are radially balanced in pressure to eliminate a radial load acting on the rotation axis of the pump.

According to the present invention, the above-described objects are attained by providing a vane type rotary pump which comprises a stator housing, a cam ring mounted within the stator housing and having an inner peripheral wall defining four circumferentially equi-spaced semicylindrical inner cam surfaces, a pair of end wall structures fitted to the opposite ends of the cam ring to form a pump cavity in the cam ring, a drive shaft rotatably mounted within the stator housing and extending into the interior of the pump cavity through one of the end wall structures, a rotor contained within the pump cavity and mounted on the drive shaft for rotation therewith, and a plurality of circumferentially equi-spaced vanes slidably fitted in the body of the rotor to move radially outwardly and cooperating with the semicylindrical inner cam surfaces and with the inner end surfaces of the end wall structures to form four pairs of suction and delivery chambers. In the rotary pump, one of the end wall structures is formed therein with four pairs of circumferentially spaced suction and delivery ports in communication with the respective suction and delivery chambers, and a pair of changeover valves are disposed within a pair of delivery passages in connection to a pair of the diametrically opposed delivery ports to connect the delivery passages to the suction ports associated with the diametrically opposed delivery ports in their activated conditions and to disconnect the delivery passages from the suction ports in their deactivated conditions.

In the rotary pump described above, the changeover valves are maintained in their deactivated conditions during low speed rotation of the pump to disconnect the delivery passages from the suction ports thereby to effect discharge of a necessary amount of fluid from all the delivery chambers. When the rotational speed of the pump exceeds a predetermined value, the changeover valves are simultanesouly activated to connect the delivery passages to the diametrically opposed suction ports thereby to return the discharged fluid from the diametrically opposed delivery chambers into the suction chambers associated therewith. As a result, the excessive amount of fluid flowing into the bypass passage of the flow control valve is decreased to reduce the load torque in operaton of the pump, and also the four pairs of the suction and delivery chambers are radially balanced in pressure to eliminate a radial load acting on the drive shaft.

BRIEF DESCRIPTION OF THE DRAWINGS

Additional objects, features and advantages of the present invention will become readily apparent from the following detailed description of a preferred embodiment thereof when considered with reference to the accompanying drawings, in which.

DETAILED DESCRIPTION OF THE PREFERRED EMBODIMENT

Figure 1:
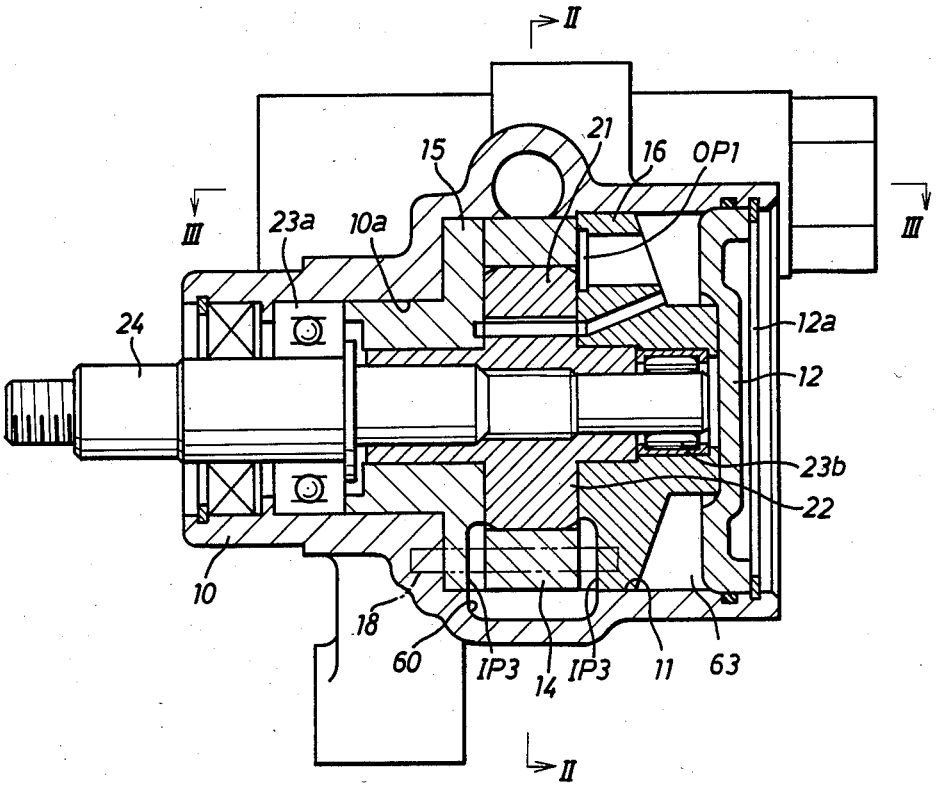
FIG. 1 is a sectional view of a vane type rotary pump in accordance with the present invention.
Figure 2:
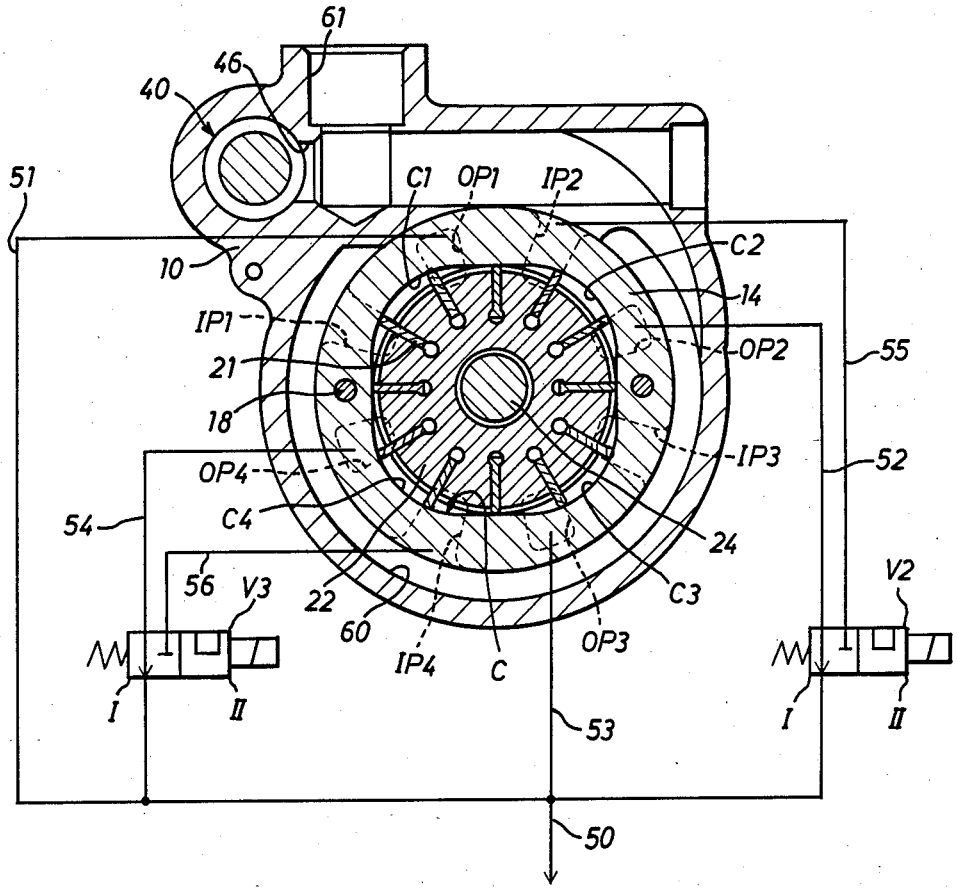
FIG. 2 is a cross-sectional view taken along line II—II in FIG. 1.

Referring now to the drawings, particularly in FIGS. 1 and 2, there is illustrated a vane type rotary pump in accordance with the present invention which comprises a stator housing 10 formed therein with an axial bore 10*a* and a cylindrical bore 11, a cam ring 14 mounted within the cylindrical bore 11 of stator housing 10, and a pair of end wall members 15 and 16 fitted to the opposite ends of cam ring 14 to form a pump cavity in the cam ring 14. As shown in FIG. 2, the cam ring 14 has an inner peripheral wall C defining four circumferentially equi-spaced semicylindrical inner cam surfaces C1, C2, C3 and C4. The diametrically opposed inner cam surfaces C1 and C3 are symmetrically arranged with respect to the rotation axis of the pump, and also the diametrically opposed inner cam surfaces C2 and C4 are symmetrically arranged with respect to the rotation axis of the pump. The end wall member 15 has a sleeve portion coupled within the axial bore 10*a* of stator housing 10 and is fixed in place by engagement with the cam ring 14 at its inner end. The end wall member 16 is engaged at its inner end with the cam ring 14 and at its outer end with the inner wall of an end cover 12 coupled in a fluid-tight manner within an opening end of stator housing 10 through an annular seal member. The end cover 12 is fixed in place by means of an annular retainer 12*a* which is engaged with an annular groove of stator housing 10 to clamp the cam ring 14 between the end wall members 15 and 16. The cam ring 14 is further fixed by circumferentially equi-spaced positioning pins 18 inserted therethrough and engaged at the opposite ends thereof with an inner wall of stator housing 10 and the end wall member 16.

The rotary pump further comprises a rotor 22 contained within the cam ring 14, and a plurality of circumferentially equi-spaced vanes 21 slidably fitted in the body of rotor 22 to move radially outwardly from the rotor responsive to centrifugal force. The rotor 22 has a pair of sleeve-like hubs rotatably coupled within the end wall members 15 and 16 and is fixedly mounted on a drive shaft 24 for rotation therewith. A roller bearing 23*a* is fixedly coupled within the axial bore 10*a* of stator housing 10 to rotatably support the drive shaft 24 thereon, and a needle bearing 23*b* is fixedly coupled within the end wall member 16 to rotatably support the inner end of drive shaft 24 thereon.

In the above-described arrangement, the vanes 21 and rotor 21 are formed slightly smaller in axial width than the cam ring 14 to provide appropriate axial clearances between the rotor 22 and the end wall members 15, 16. When the rotor 22 is driven by the drive shaft 24, the vanes 21 are guided by the respective semicylindrical inner cam surfaces C1, C2, C3 and C4 of cam ring 14 to form four pairs of suction and delivery chambers. The end wall members 15 and 16 are formed at their inner end faces with four circumferentially equi-spaced suction ports IP1, IP2, IP3 and IP4 in open communication with the respective suction chambers formed by cam surfaces C1, C2, C3 and C4. The end wall members 15 and 16 are further formed at their inner end faces with four circumferentially equi-spaced delivery ports OP1, OP2, OP3 and OP4 in open communication with the respective delivery chambers formed by cam surfaces C1, C2, C3 and C4.

Figure 3:
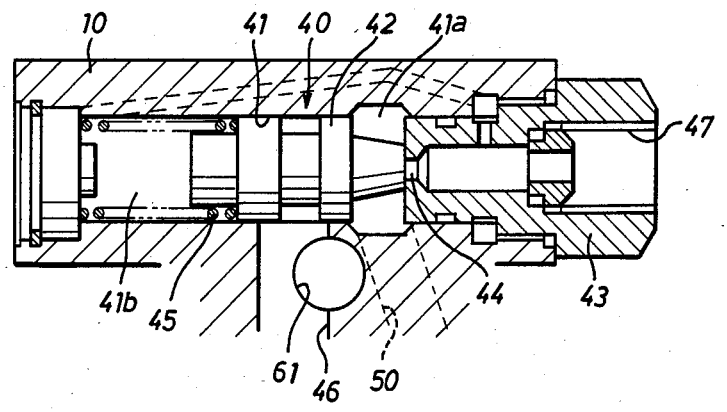
FIG. 3 is a sectional view of a flow control valve assembled within the rotary pump of FIG. 1.

The suction ports IP1, IP2, IP3 and IP4 are communicated with an inlet passage 61 and a bypass passage 46 through an annular groove 60 formed in the peripheral wall of cylindrical bore 11. The inlet passage 61 is connected to a fluid reservoir (not shown) of the rotary pump. The delivery ports OP1, OP2, OP3 and OP4 are connected to delivery passages 51, 52, 53 and 54 which are connected with each other at their intermediate portions to provide a common delivery passage 50 in communication with a flow control valve 40. As shown in FIGS. 2 and 3, the flow control valve 40 is arranged within the upper portion of stator housing 10 to control the flow quantity of fluid discharged from the common delivery passage 50 into the bypass passage 46. The flow control valve 40 comprises a spool 42 slidably disposed within an axial bore 41 in stator housing 10 to subdivide the interior of axial bore 41 into fluid chambers 41*a* and 41*b*. The fluid chamber 41*a* is in open communication with the common delivery passage 50, while the fluid chamber 41*b* is communicated with an axial bore in a plug member 43 which is threaded into an opening end of axial bore 41 in a fluid-tight manner. The plug member 43 is formed at the inner end thereof with a throttle 44 and formed at the outer end thereof with an opening 47 for connection to a hydraulic circuit (not shown). Thus, the fluid chamber 41*b* is communicated with the downstream of throttle 44 in plug member 43, and the spool 42 is biased toward the throttle 44 under load of a compression spring 45. In operation, the spool 42 is displaced by the difference in pressure between fluid chambers 41*a* and 41*b* to control the flow of fluid between the common delivery passage 50 and the bypass passage 46 thereby to constantly supply a predetermined quantity of pressurized fluid to the hydraulic circuit through the opening 47.

In the above-described arrangement of the delivery passages in the rotary pump, a pair of electrically operated changeover valves V2 and V3 are respectively disposed within the delivery passages 52 and 54 to connect them to the suction ports IP2 and IP4 through return passages 55 and 56 respectively in their energized conditions. The changeover valves V2 and V3 are connected to an electric control circuit (not shown) to be simultaneously energized in accordance with increase of the rotational speed of the rotary pump. In addition, the delivery ports OP1 and OP3 are in open communication with a pressure chamber 63 formed between the end cover 12 and the end wall member 16.

Figure 4:
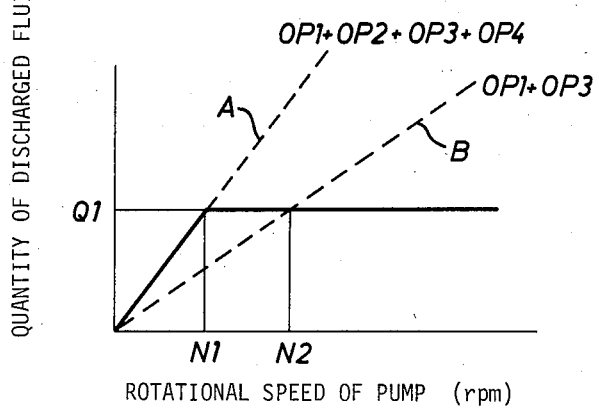
FIG. 4 is a graph illustrating the quantity of discharged fluid in relation to the rotational speed of the rotary pump.

During rotation of the rotary pump, the fluid from inlet passage 61 is sucked into the suction chambers in cam ring 14 through the annular groove 60 and the suction ports IP1, IP2, IP3 and IP4 and compressed in the delivery chambers in cam ring 14 to be discharged from the delivery ports OP1, OP2, OP3 and OP4 respectively. Assuming that the rotor 22 is rotated by the drive shaft 24 at a low speed, the changeover valves V2 and V3 are maintained in their deenergized conditions as shown in the figure to permit the flow of fluid discharged into the common delivery passage 50 from the delivery ports OP1, OP2, OP3 and OP4, and the flow control valve 40 is conditioned to permit all the flow of fluid delivered from its opening 47 into the hydraulic circuit. Thus, the four pairs of suction and delivery chambers are radially balanced in pressure to eliminate a radial load acting on the drive shaft 24. When the rotational speed of the rotor 22 exceeds a first value N1 as shown in FIG. 4, the quantity of fluid discharged from the delivery ports OP1, OP2, OP3 and OP4 exceeds a necessary quantity Q1 for the hydraulic circuit as shown by a first dotted line A in FIG. 4. At this stage, the flow control valve 40 is conditioned to permit the flow of an excessive amount of fluid into the bypass passage 46.

When the rotational speed of the rotor 22 reaches a second value N2 as shown in FIG. 4, both the changeover valves V2 and V3 are simultaneously energized in response to an electric signal applied thereto from the control circuit to connect the delivery passages 52 and 54 to the return passages 55 and 56, respectively. Thus, the discharged fluid from the delivery ports OP2 and OP4 flows into the suction ports IP2 and IP4 to decrease the load acting on the rotary pump, and only the discharged fluid from the delivery ports OP1 and OP3 flows into the common delivery passage 50. Subsequently, the quantity of fluid discharged from the delivery ports OP1 and OP3 increases in accordance with increase of the rotational speed of the rotor 22 as shown by a second dotted line B in FIG. 4, and the flow control valve 40 is conditioned to permit the flow of an excessive amount of fluid into the bypass passage 46. In such operation of the rotary pump under energized condition of the changeover valves V2 and V3, the diametrically opposed suction and delivery chambers in communication with ports OP1 and OP2 are radially balanced in pressure, and the diametrcially opposed suction and delivery chambers in communication with ports OP2 and OP4 are radially balanced in pressure to eliminate an excessive radial load acting on the drive shaft 24. From the above description, it will be understood that under control of the changeover valves V2 and V3, the excessive amount of fluid flowing into the bypass passage 46 is decreased in accordance with increase of the rotational speed of the pump to reduce the load torque acting on the rotary pump.

Although a certain specific embodiment of the present invention has been shown and described, it is obvious that many modifications and variations thereof are possible in light of these teachings. It is to be understood, therefore, that within the scope of the appended claims, the invention may be practiced otherwise than as specifically described herein.

What is claimed is:

1. A vane type rotary pump comprising:

a stator housing;

a cam ring mounted within said stator housing and having an inner peripheral wall defining four circumferentially equi-spaced semicylindrical inner cam surfaces;

a pair of end wall structures fitted to the opposite ends of said cam ring to form a pump cavity in said cam ring;

a drive shaft rotatably mounted within said stator housing and extending into the interior of said pump cavity through one of said end wall structures;

a rotor contained within said pump cavity and mounted on said drive shaft for rotation therewith; and a plurality of circumferentially equi-spaced vanes slidably fitted in the body of said rotor to move radially outwardly and cooperating with the semicylindrical inner cam surfaces of said cam ring and with the inner end surfaces of said end wall structures to form four pairs of circumferentially equi-spaced suction and delivery chambers;

wherein one of said end wall structures is formed therein with four pairs of circumferentially spaced suction and delivery ports in communication with said respective suction and delivery chambers, and wherein a pair of changeover valves are disposed within a pair of delivery passages in connection to a pair of the diametrically opposed delivery ports to connect said delivery passages to the suction ports associated with the diametrically opposed delivery ports in their activated conditions and to disconnect said delivery passages from the suction ports in their deactivated condition.

2. A vane type rotary pump as claimed in claim 1, wherein said changeover valves are a pair of electrically operated valves disposed within the pair of the delivery passages to be simultaneously energized when the rotational speed of said drive shaft exceeds a predetermined value.

* * * * *